US007821459B2

(12) United States Patent
Su et al.

(10) Patent No.: US 7,821,459 B2
(45) Date of Patent: Oct. 26, 2010

(54) MULTI-BAND ANTENNA

(75) Inventors: Wen-Fong Su, Tu-Cheng (TW); Chen-Ta Hung, Tu-Cheng (TW); Shu-Yean Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 414 days.

(21) Appl. No.: 11/825,891

(22) Filed: Jul. 10, 2007

(65) Prior Publication Data

US 2008/0007461 A1 Jan. 10, 2008

(30) Foreign Application Priority Data

Jul. 10, 2006 (TW) ..... 95125030 A

(51) Int. Cl.
*H01Q 1/38* (2006.01)

(52) U.S. Cl. ..... 343/700 MS; 343/702; 343/846

(58) Field of Classification Search ..... 343/700 MS, 343/702, 829, 846
See application file for complete search history.

(56) References Cited

FOREIGN PATENT DOCUMENTS

| | | |
|---|---|---|
| TW | 410488 | 11/2000 |
| TW | 558084 | 10/2003 |
| TW | 253070 | 12/2004 |

*Primary Examiner*—Tho G Phan
(74) *Attorney, Agent, or Firm*—Wei Te Chung; Andrew C. Cheng; Ming Chieh Chang

(57) ABSTRACT

A multi-band antenna includes a radiating element having at least two frequency bands and comprising a gap on one side edge thereof, a grounding element coupling and being perpendicular to said radiating element, and a reactance assembled to said radiating element and received in said gap.

16 Claims, 5 Drawing Sheets

MULTI-BAND ANTENNA

BACKGROUND OF THE INVENTION

1. Field of the Invention

The present invention relates generally to a multi-band antenna, and more particularly to a multi-band antenna used for electronic devices, such as notebooks.

2. Description of the Prior Art

With the high-speed development of the mobile communication, people more and more expect to use a computer or other portable terminals to optionally connect to Internet. GPRS (General Packer Radio Service) and WLAN (Wireless Local Area Network) allow users to access data wirelessly over both cellular networks and 802.11b WLAN system. When operating in GPRS, the data transmitting speed is up to 30 Kbps~50 Kbps, while when connected to a WLAN access point, the data transmitting speed is up to 11 Mbps. People can select different PC cards and cooperate with the portable terminals such as the notebook computer or the like to optionally connect to Internet. Since WLAN has a higher transmitting speed, WLAN is usually used to provide public WLAN high-speed data services in some hot areas (for example, hotel, airport, coffee bar, commerce heartland, conference heartland and etc.). When leaving from these hot areas, network connection is automatically switched to GPRS.

As it is known to all, an antenna plays an important role in wireless communication. As a result, the PC card may choose individual antennas to respectively operate at WWAN (Wireless Wide Area Network), namely GPRS, and WLAN. It arises a hot problem to integrate two individual antennas in a limited space to go along with the miniaturization of portal devices. Please refer to FIG. 1, a multi-band antenna 10' comprises a first type of antenna which is used in WWAN and has first and second antennas 1', 2' and a second type of antenna which is used in WLAN and has third and fourth antennas 3', 4'. The multi-band antenna 10' is integrally made from a metal sheet and integrates the first type of antenna for WWAN and the second type antenna for WLAN together. However, with the two types of antennas integration, the interference therebetween will become greater, and owing to this structure, the multi-band antenna 10' can not achieve desired bandwidth. TW pat. No. 253070 discloses a wide band antenna. As shown in FIG. 2 of TW Pat. No. 253070, the wide band antenna has a gap 30 formed by cutting the radiating portion 24 of the antenna and an inductance is soldered on the position of the gap 30, so that the radiating portion 24 of the antenna become an integer. However, the method of soldering a reactance on an antenna is difficult to achieve except the antenna is arranged on a PCB. In present removable devices, one most popular antenna, PIFA antenna for short, is used widely. Because of the lack of the supporting from a PCB, said means of assembling a reactance don't conform to this kind of antenna.

Hence, an improved antenna is desired to overcome the above-mentioned shortcomings of the existing antennas.

BRIEF SUMMARY OF THE INVENTION

A primary object, therefore, of the present invention is to provide a multi-band antenna used in WWAN and WLAN with simple structure to achieve a good impedance, and the antenna has low cost and easy manufacture.

In order to implement the above object and overcomes the above-identified deficiencies in the prior art, the multi-band antenna comprises a radiating element having at least two frequency bands and comprising a gap on one side edge thereof, a grounding element, a reactance, wherein the reactance is assembled on said gap to be received in.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
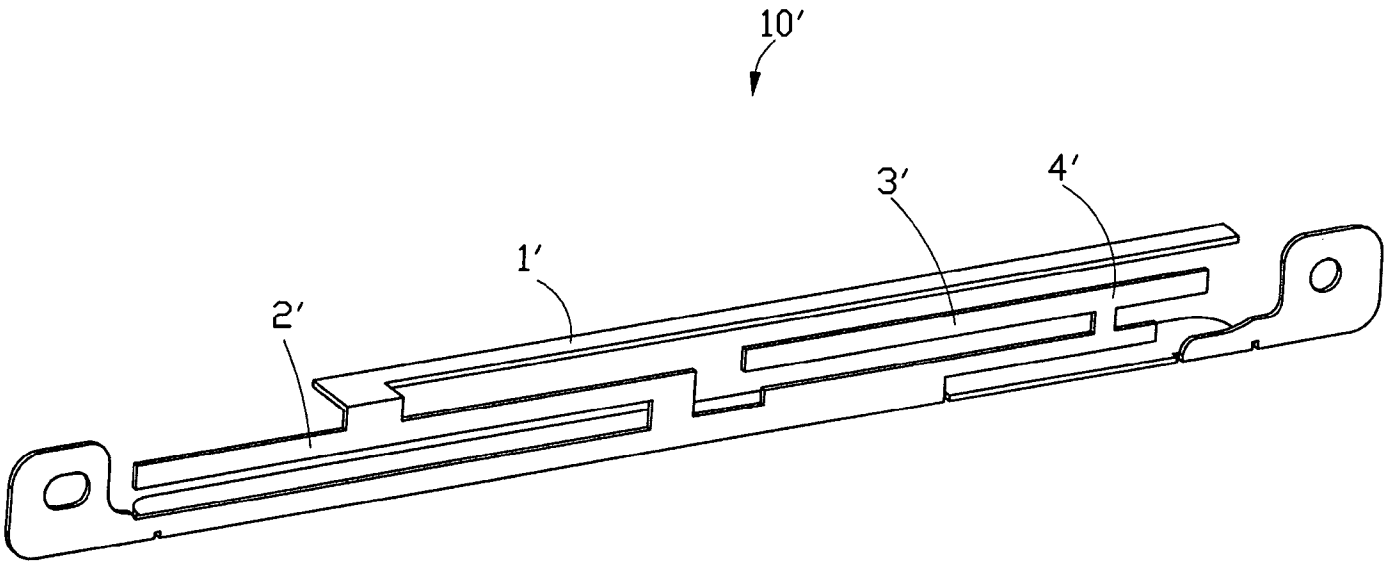
FIG. 1 (PRIOR ART)
FIG. 1 is a perspective view illustrating a conventional multi-band antenna.
Figure 2:
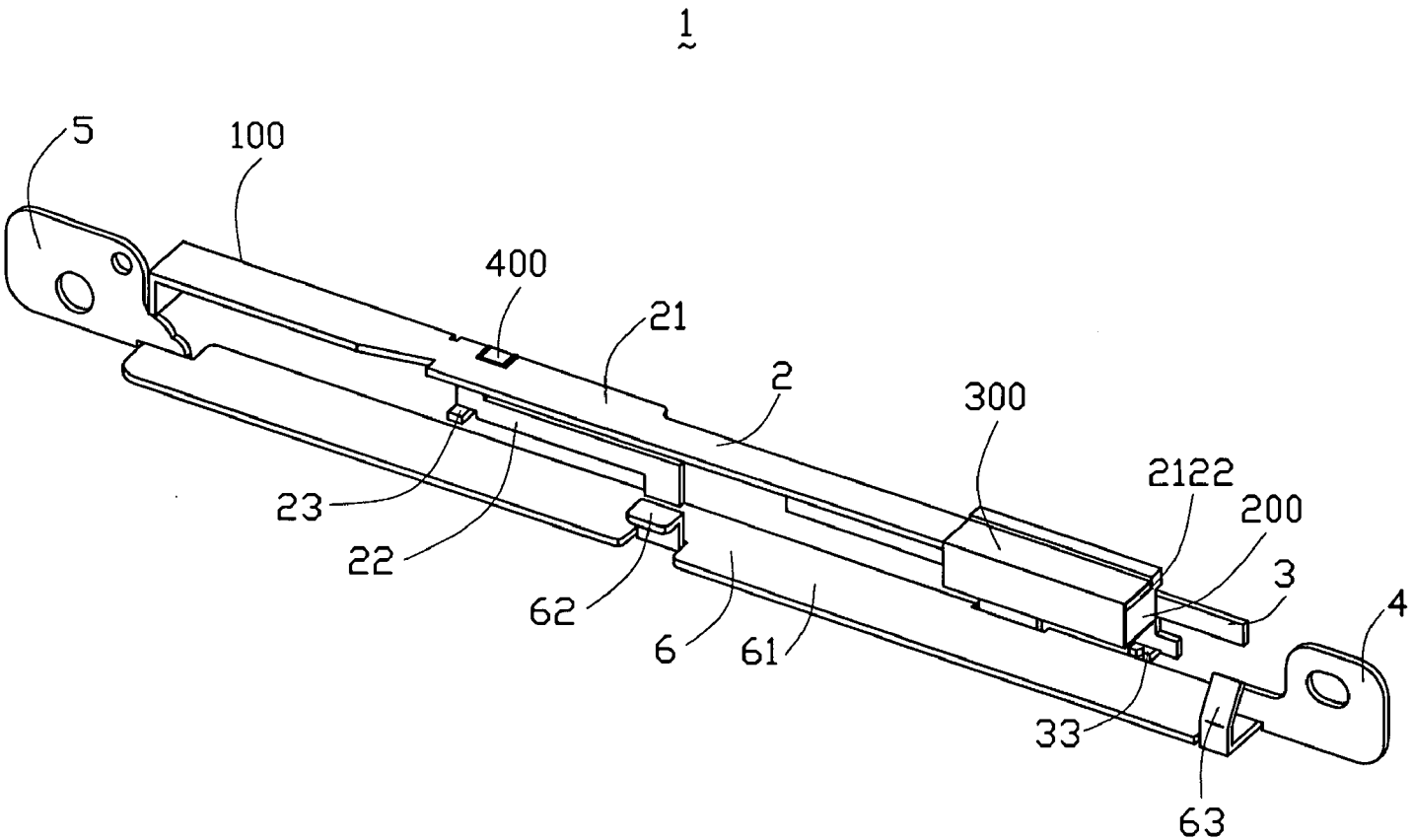
FIG. 2 is a perspective view of a multi-band antenna according to a preferred embodiment of the present invention.
Figure 3:
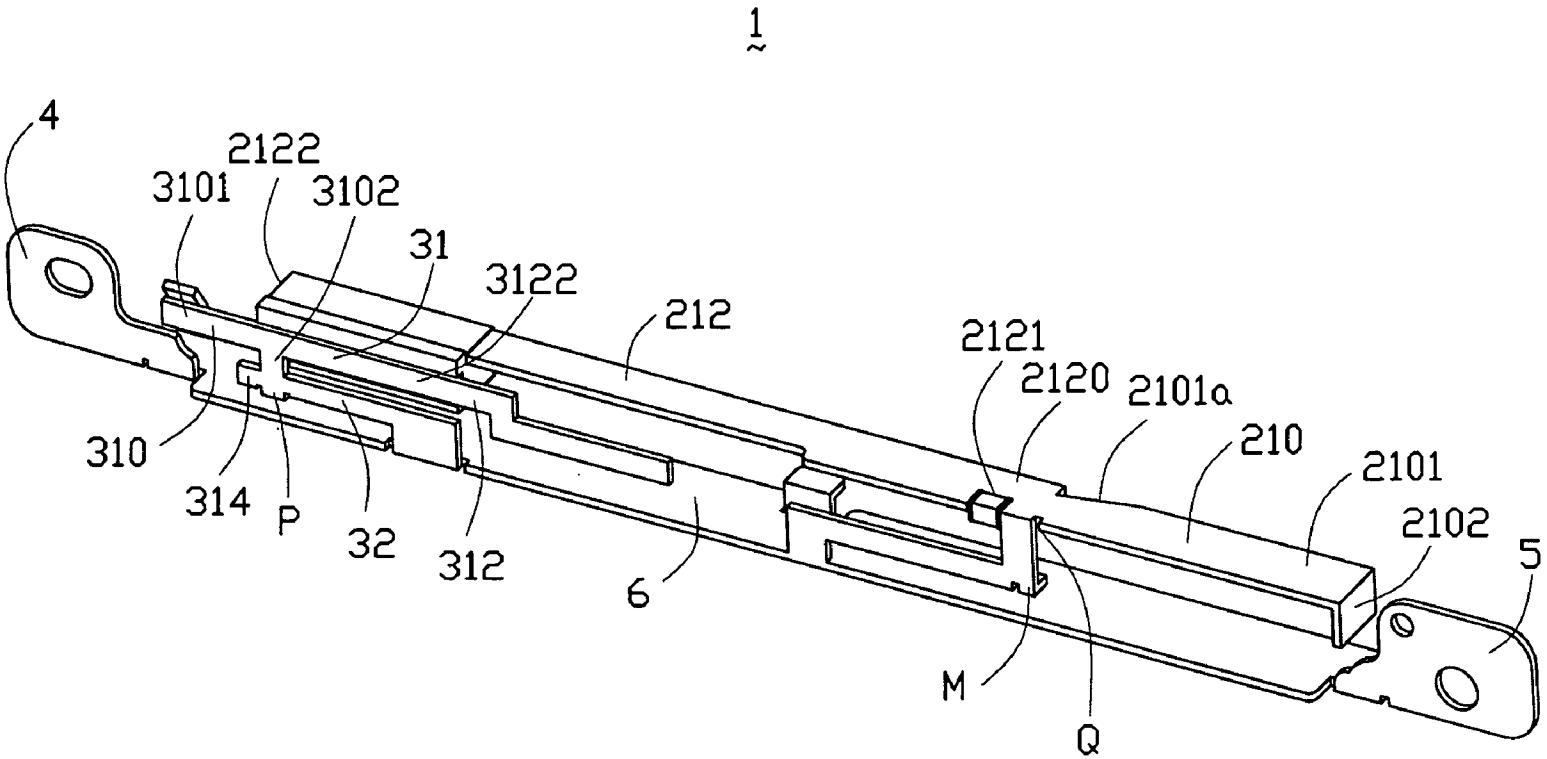
FIG. 3 is a view similar to FIG. 2, but take from a different aspect.
Figure 4:
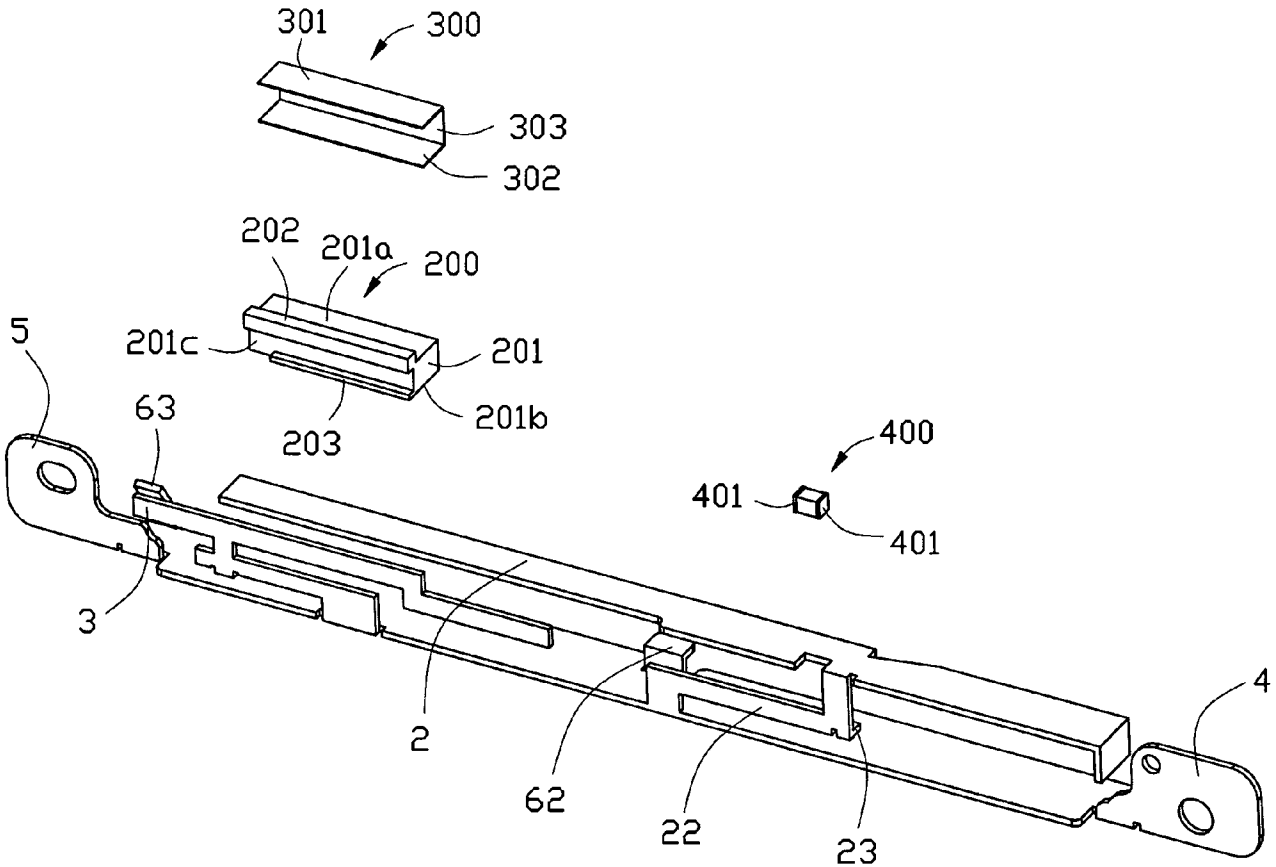
FIG. 4 is an exploded, perspective view of the multi-band antenna of FIG. 3.

Reference to FIG. 2 to FIG. 4, a perspective view of a multi-band antenna 1 in accordance with a preferred embodiment of the present invention is shown. The multi-band antenna 1 consists of an antenna body 100, an insulative member 200 affixed to the antenna body 100, a metal foil 300 and a reactance 400 soldered on the antenna body 100. The multi-band antenna 1 also comprises a first antenna 2 used in WWAN, a second antenna 3 used in WLAN, a grounding element 6 integrally formed with the first antenna 2 and the second antenna 3, and a pair of fitting elements 4, 5 for mounting the multi-band antenna 1 to an electronic device. In this embodiment, the insulative member 200, the metal foil 300 and the reactance 400 are all on the first antenna 2. The antenna body 100 of the multi-band antenna 1 is made of a metal patch with a pressing means, which combine a WWAN antenna and a WLAN antenna. The grounding element 6 comprises a first grounding portion 61, an L-shape metal patch 62 extending upwardly from the middle area of the first grounding portion 61, and a metal patch 63 with interrupted shape.

The first antenna 2 comprises a radiating element 21, a grounding element 6, a connecting portion 22 connecting the radiating element 21 and the grounding element 6 and a protrusion 23 extending from the connecting portion 22 to connect a feeding line (not shown). The radiating element 21 is separated from and parallel to the grounding element 6, and the radiating element 21 and are located on the same side of the connecting portion 22. The radiating element 21 comprises a high-frequency radiating portion 210 and a low-frequency radiating portion 212. The high-frequency radiating portion 210 comprises a first radiating arm 2101 having a triangle-shape notch 2101*a* and a second radiating arm 2102 bending from the first radiating arm 2101 to the grounding element 6. The low-frequency radiating portion 212 is a metal patch with interrupted shape like an "L". The low-frequency radiating portion 212 comprises a first end 2120 connecting with the high-frequency radiating portion 210 and a second end 2122 opposite to the first end 2120 with a narrower width than that of the first end 2120. A gap 2121 is defined by the first end 2120 by cutting itself on one side thereof to receive the reactance 400. The insulative member 200 and the metal foil 300 are plastered to the second end 2122. In this embodiment, the insulative member 200 comprises a rectangle main body 201, a rib 202 extending from the joint of the upper surface 201*a* and the side 201*c* of the main body 201, and a bar 203 extending from the joint of the lower surface 201*b* and the side 201*c* of the main body 201. The side 201*c*, the rib 202 and the bar 203 constitute a cavity (not labeled). The upper surface 201*a* of the main body 201 is plastered on the surface, opposite to the grounding element 6, of the low-frequency radiating portion 212 of the first antenna 2. The side 201*c* is adjacent to the second antenna 3. The second antenna 3 is partially received in the cavity defined by the upper surface 201*a*, the rib 202 and the bar 203. The metal foil 300 is inverted-U shape, and plastered to the low-frequency radiating portion 202 to enclose the insulative member 200. The metal foil 3 comprises an upper wall 301, a lower wall 302 and a side wall 303. The metal foil 300 opens toward the second antenna 3. The upper wall 301 is fixed on the surface, facing to the grounding element 6, of the first antenna 2. The side wall 303 cover the side, opposite to the side 201*c*, of the insulative member 200. The lower wall 302 is plastered to the lower surface 201*b* of the insulative member 200. The metal foil 300 never touches the second antenna 3. The metal foil 300 induces the area of the low-frequency radiating portion 212 of the second antenna rather than the length of the low-frequency radiating portion 212, and then the band width of the low-frequency radiating portion 212 increases. To reduce the interference between the first antenna 2 and the second antenna 3, a certain distance is needed therebetween. So the shape of the insulative member 200 is designed to fasten the first antenna 2 and the second antenna 3 together while still keeps the certain distance to reduce the interference between the first antenna 2 and the second antenna 3. At the same time, the insulative member 200 supports the metal foil 300. In alternative embodiment, the location site and shape of the insulative member 200 can be changed if needed. The reactance 400 locates in the gap 2121 of the low-frequency radiating portion 212 and defines a tinned area on its surface to solder itself on the low-frequency radiating portion 212. The reactance 400 can be assembled on the other radiating portion, such as the high-frequency radiating portion 210. The reactance 400 can be not only a Multi Layer Ceramic Capacitor but also a Multi Layer Ceramic Inductance. The protrusion 23 extends from a point M on the connecting portion 22 along the direction parallel to the grounding element 6. The protrusion 23 is located on the same side of the connecting portion 22 same as the grounding element 6.

The high-frequency radiating portion 210 is on a first plane same as the low-frequency radiating portion 212 of the first antenna 2. The connecting portion 22, extends from the joint of the high-frequency radiating portion 210 and the low-frequency radiating portion 212, is Z shape and on a second plane perpendicular to the first plane. The connecting portion 22 connects the high-frequency radiating portion 210 and the low-frequency radiating portion 212 on a point Q. The gap 2121 of the low-frequency radiating portion 212 is adjacent to the point Q, while the triangle gap 2101*a* is located on a side of the high-frequency radiating portion 210 opposite to the point Q.

The second antenna 3 comprises a radiating element 31, a grounding element 6, a connecting portion 32 connecting the radiating element 31 and the grounding element 6, and a heave 33 connecting a feeding line (not shown). The radiating element 31 comprises a high-frequency radiating portion 310, a low-frequency radiating portion 312, a third radiating portion 314 and a common arm 3102 shared by the high-frequency radiating portion 310 and the low-frequency radiating portion 312 together. The common arm 3102 is perpendicular to the high-frequency radiating portion 310 and the low-frequency radiating portion 312. The high-frequency radiating portion 310 also comprises a lengthwise radiating arm 3101, and the low-frequency radiating portion 312 comprises a second radiating arm 3122, Z shaped, extending along a direction reverse to the lengthwise radiating arm 3101. The third radiating portion 314 connects the common radiating arm 3102 and the connecting portion 32 on a point P together. The radiating element 31 of the second antenna 3 is located on a plane same as the connecting portion 32, and on the same side of the grounding element 6 as the radiating element 21 and the connecting portion 22 of the first antenna 2.

Figure 5:
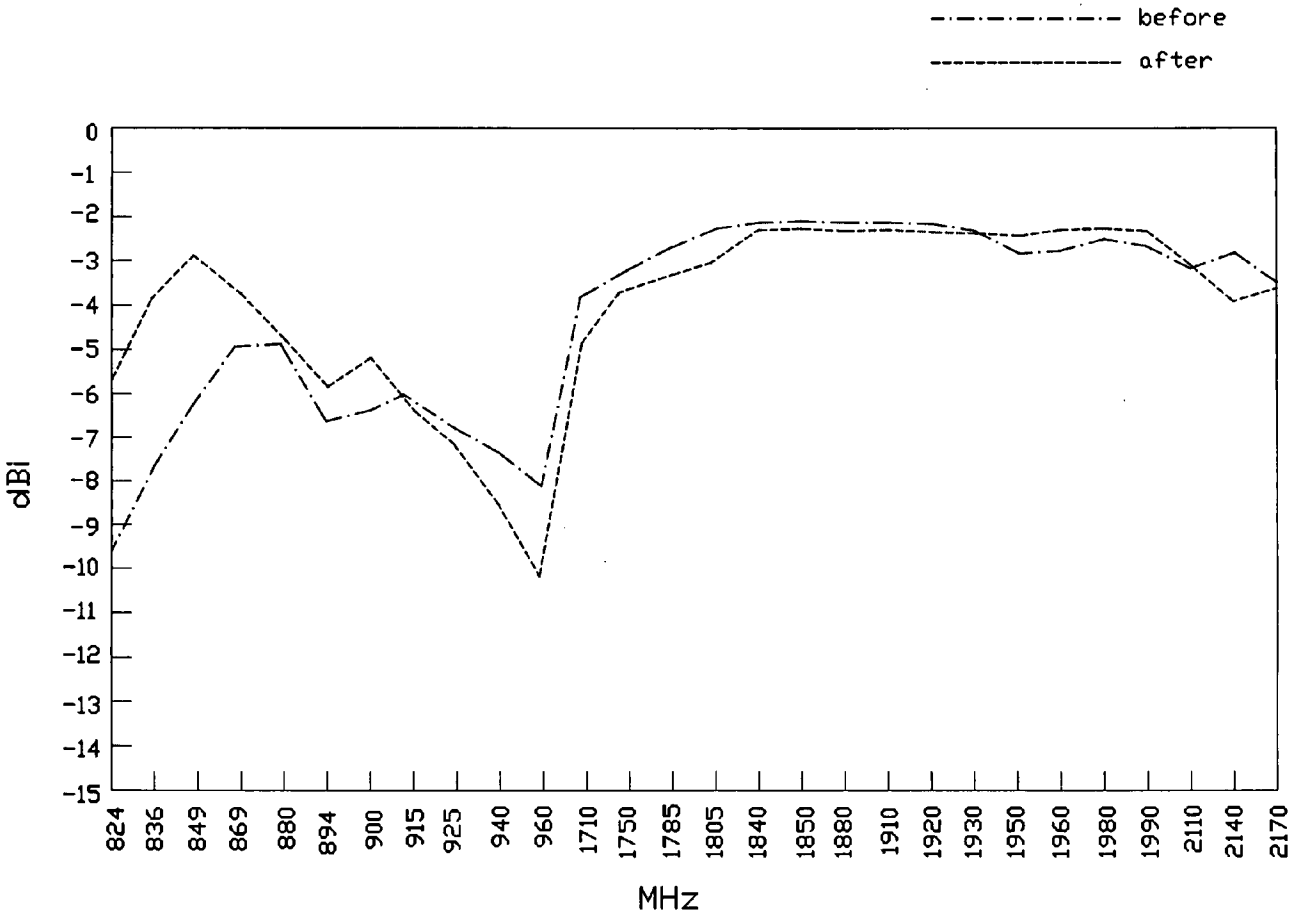
FIG. 5 is a test chart recording of Voltage Standing Wave Ratio (VSWR) of the multi-band antenna with reactance and without reactance as a function of frequency.

In this embodiment of the present invention, the high-frequency radiating portion 210 of the first antenna 2 is used to receive and send the high frequency signal on 1800-1900 MHz, and the low-frequency radiating portion 212 is used to receive and send the low frequency signal on 900 MHz. The high-frequency radiating portion 310 of the second antenna 3 is used to receive and send the high frequency signal on 5 GHz, and the low-frequency radiating portion 312 is used to receive and send the low frequency signal on 2.4 GHz. The low-frequency radiating portion 212 of the first antenna 2 is adjacent to the low-frequency radiating portion 312 of the second antenna 3. It's known that the radiating performance is greatly influenced by the impedance. In this embodiment, the first antenna 2 has small volume compared with conventional antenna while still has substantially same frequency and bandwidth because the aid of the insulative member 200 and the metal foil 300. In addition, the existence of the reactance 400 regulates the impedance to increase the power of the low-frequency radiating portion 212. FIG. 5 illustrates two gain curves of the first antenna 2 with the reactance 400 and without the reactance 400. The gain increases 2 dBi when the reactance 400 is imported. Therefore, the antenna assembled reactance achieves good performance. Besides the excellent performance mentioned above, this method of assembling a reactance to the radiating element of the antenna of this embodiment has a simple manufacture process and low cost. In other embodiment, the reactance 400 can be assembled on different positions of different antennas in need.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna, comprising:

a radiating element having at least two frequency bands, and comprising a gap on one side edge thereof;

a grounding element, coupling and being perpendicular to said radiating element; and a reactance, assembled to said radiating element and received in said gap.

2. The multi-band antenna as claimed in claim 1, wherein said reactance is soldered with said radiating element to be received in.

3. The multi-band antenna as claimed in claim 2, wherein said first antenna comprises a high-frequency radiating portion used on the 1800-1900 MHz band and a low-frequency radiating portion used on the 900 MHz band, said second antenna comprises a high-frequency radiating portion used on the 5 GHz band and a low-frequency radiating portion used on the 2.4 GHz band.

4. The multi-band antenna as claimed in claim 1, wherein said reactance is at least one of a Multi Layer Ceramic Capacitor or a Multi Layer Ceramic Inductance.

5. The multi-band antenna as claimed in claim 1, wherein said radiating element comprises a low-frequency radiating portion and a high-frequency radiating portion, said reactance is assembled on said low-frequency radiating portion.

6. The multi-band antenna as claimed in claim 1, wherein said multi-band antenna comprises a first antenna worked at the WWAN, a second antenna worked at the WLAN, and said grounding element on which both said first antenna and said second antenna are, said first antenna comprises a low-frequency radiating element adjacent to the low-frequency radiating element defined by said second antenna.

7. The multi-band antenna as claimed in claim 6, wherein said high-frequency radiating element of said first antenna comprises a triangle-shape notch.

8. The multi-band antenna as claimed in claim 6, further comprising a connecting portion connecting said radiating element of said first antenna to said grounding element, and a connecting portion connecting said radiating element of said second antenna to said grounding element.

9. The multi-band antenna as claimed in claim 8, wherein said connecting portion of said first antenna is on a plane different from the plane on which said radiating element of said first antenna is.

10. The multi-band antenna as claimed in claim 8, wherein said connecting portion of said second antenna is on a plane same as the plane on which said radiating element of said second antenna is.

11. The multi-band antenna as claimed in claim 8, further comprising an insulative member assembled on said low-frequency radiating portion of said first antenna.

12. The multi-band antenna as claimed in claim 11, wherein said insulative member defines a cavity, and wherein said second antenna is partially received in said cavity.

13. The multi-band antenna as claimed in claim 11, wherein said insulative member comprises a main body, a rectangle rib extending from the joint of the upper surface and side of said main body, and a bar extending from the joint of said lower surface and the side of said main body to constitute said cavity.

14. The multi-band antenna as claimed in claim 11, wherein said first antenna comprises a metal foil plastered on said low-frequency radiating portion and said insulative member.

15. The multi-band antenna as claimed in claim 1, wherein said gap is located on one end of said low-frequency radiating portion adjacent to said high-frequency radiating portion, said reactance has an tinned area to solder itself to said low-frequency radiating portion.

16. A multi-band antenna, comprising:

a radiating element having at least two frequency bands;

a grounding element, coupled to said radiating element via a connection portion which is electrically and mechanically connected between and to the grounding element and the radiating element, respectively; and a reactance assembled to said radiating element: wherein said reactance is intimately located beside the connection portion.

* * * * *